US011700963B2

(12) United States Patent
St. Angelo

(10) Patent No.: US 11,700,963 B2
(45) Date of Patent: Jul. 18, 2023

(54) COLLAPSIBLE FREE STANDING STOCKING

(71) Applicant: Richard Anthony St. Angelo, Cranston, RI (US)

(72) Inventor: Richard Anthony St. Angelo, Cranston, RI (US)

( * ) Notice: Subject to any disclaimer, the term of this patent is extended or adjusted under 35 U.S.C. 154(b) by 2 days.

(21) Appl. No.: 16/690,885

(22) Filed: Nov. 21, 2019

(65) Prior Publication Data

US 2020/0187695 A1 Jun. 18, 2020

Related U.S. Application Data

(60) Provisional application No. 62/781,111, filed on Dec. 18, 2018.

(51) Int. Cl.

| | |
|---|---|
| ***A47G 33/04*** | (2006.01) |
| ***A41F 13/00*** | (2006.01) |
| *A47G 33/00* | (2006.01) |

(52) U.S. Cl.

CPC ..... *A47G 33/04* (2013.01); *A41F 13/00* (2013.01); *A47G 33/00* (2013.01)

(58) Field of Classification Search

CPC ..... A47G 33/04; A47G 33/00; A41F 13/00

See application file for complete search history.

(56) References Cited

U.S. PATENT DOCUMENTS

| | | | | |
|---|---|---|---|---|
| D17,171 S | | 3/1887 | Hurlbut et al. | |
| 1,844,960 A | | 2/1932 | Kingman | |
| 2,034,897 A | * | 3/1936 | Crane | A41B 11/12 2/240 |
| D110,245 S | | 6/1938 | Garry et al. | |
| 2,302,392 A | | 11/1942 | Risch | |
| 2,317,554 A | | 4/1943 | Risch | |
| 2,785,724 A | * | 3/1957 | Gold | B65D 37/00 220/9.2 |
| D289,585 S | | 5/1987 | Lord | |
| 4,765,520 A | | 8/1988 | Barton | |
| 5,195,638 A | | 3/1993 | Zinbarg | |

(Continued)

OTHER PUBLICATIONS

Walmart, "Holiday Time Christmas Décor Velvet 9" Standing Stocking", 2016, p. 1-13; https://www.walmart.com/ip/Holiday-Time-Christmas-Decor-Velvet-9-Standing-Stocking/52617519?selected=true.*

Dietz, E.; "How to Make a Weighted Base for Your Crochet Projects", screenshots from Youtube video, 2017; https://www.youtube.com/watch?v=v5DT67wz4zc&t=341.*

Caroeas, "Rolling Laundry Cart, CAROEAS 22" with Stand Foldable Waterproof Sorter and Organizer on Wheels", 2017, p. 1-15 and zoomed graphic; https://www.amazon.com/gp/product/B0772PCYZ1/ref=ask_ql_qh_dp_hza.*

(Continued)

*Primary Examiner* — Mark Ruthkosky
*Assistant Examiner* — Julia L Rummel
(74) *Attorney, Agent, or Firm* — Dunlap Bennett & Ludwig, PLLC; Anna L. Kinney

(57) ABSTRACT

A collapsible free standing stocking is disclosed. This invention removes the danger from a stocking that hangs over a flame (of any kind). It also eliminates the danger of being pulled off from a mount having heavy weighted holder and crushing a child head, a person's foot or injuring a pet. It eliminates the need of nailing, screwing or attaching hooks into mantels. The collapsible stocking includes a footpad that is received in a foot portion of the stocking. A weighted sock is dimensioned to be received within the foot portion and carries a malleable weighted material, which may be a granular or pelletized material. A plurality of sleeves and a corresponding plurality of rods support an upper sleeve portion of the stocking body in an upright orientation.

6 Claims, 3 Drawing Sheets

(56) References Cited

U.S. PATENT DOCUMENTS

| | | | | |
|---|---|---|---|---|
| 5,389,028 | A | 2/1995 | Cabrera et al. | |
| 5,458,932 | A | 10/1995 | Zinbarg et al. | |
| 5,534,315 | A | 7/1996 | Witte | |
| 6,186,662 | B1 | 2/2001 | Jackson | |
| 6,327,816 | B1 | 12/2001 | Walterscheid | |
| 6,558,037 | B2 | 5/2003 | Gonella | |
| 6,568,504 | B2 | 5/2003 | Cowgill et al. | |
| 7,261,233 | B2 | 8/2007 | Menghini | |
| 7,374,136 | B1 | 5/2008 | Perea | |
| D705,118 | S | 5/2014 | Dubow | |
| D795,736 | S | 8/2017 | Ochi | |
| 2004/0264213 | A1 | 12/2004 | Davis | |
| 2008/0163530 | A1 | 7/2008 | Smith et al. | |
| 2010/0320337 | A1 | 12/2010 | Bennett et al. | |
| 2013/0277246 | A1 | 10/2013 | Glass et al. | |
| 2015/0156989 | A1* | 6/2015 | Ruetenik ..... | A01K 13/007 168/28 |

OTHER PUBLICATIONS

Smart, A., "Diary of a Quilter", 2012, p. 1-27; https://www.diaryofaquilter.com/christmas-stocking-tutorial/.*

Oxford English Dictionary, "Plush, n.1 and adj.", oed.com, p. 1-5; Accessed on Jan. 4, 2022 at https://www.oed.com/view/Entry/146227?isAdvanced=false&result=1&rskey=kQbJYM&&print.*

Vintage German Composition Santa Claus Boot Novelty Christmas Candy Container (n.d.). Retrieved Oct. 24, 2019, from https://www.etsy.com/listing/569617775/vintage-german-composition-santa-claus?show_sold_out_detail=1.

Disney Princess Standing Christmas Stocking (n.d.). Retrieved Oct. 24, 2019, from https://www.biglots.com/product/standing-christmas-stocking/p810318157.

St. Angelo, Richard Anthony. (2008). Standing Stockings (tm) by 2 Saints [Brochure]. n.p.:Author.

* cited by examiner

COLLAPSIBLE FREE STANDING STOCKING

CROSS-REFERENCE TO RELATED APPLICATION

This application claims the benefit of priority of U.S. provisional application No. 62/781,111, filed Dec. 18, 2018, the contents of which are herein incorporated by reference.

BACKGROUND OF THE INVENTION

The present invention relates to Christmas decorations, and, more particularly, to Christmas stocking decorations.

Traditional and/or conventional hanging Christmas stockings have several major problems, particularly those that rely on weighted hangers that rest atop a fireplace mantle, tables, or other flat support surfaces. The weighted hangers have caused thousands of children injuries from the weighted holder being pulled from atop fireplace mantles. Conventional hanging fireplace stockings are also a highly flammable decoration whether using gas or a traditional wood-burning fireplaces. Their close proximity to the heat and embers present a significant fire hazard.

For those that rely on nails, hooks or screws to hang their stockings, these tend to cause extensive damage to expensive mantles. Thus, traditional stockings that hang from atop a fireplace mantel whether nailed, screwed in or from a weighted holder can cause serious bodily harm (or even death) by falling or by hanging to close to a fire and cause irreparable damage.

As can be seen, there is a need for an improved decorative stocking that eliminates these hazards.

SUMMARY OF THE INVENTION

In one aspect of the present invention, a collapsible free standing stocking, is disclosed. The collapsible free standing stocking may include a stocking having a top opening into an interior cavity of the stocking. A weighted sock is dimensioned to be received in a foot portion of the stocking. A plurality of sleeves are disposed in a spaced apart relation about a circumferential dimension of an upper sleeve portion of the stocking. A plurality of rods, having a length corresponding to a length of the upper sleeve portion, are adapted to be received in the plurality of sleeves.

In other embodiments, a footpad is dimensioned to be received within the foot portion of the stocking along a base thereof. The footpad may be formed of a rigid or semi-rigid material.

In other embodiments, the weighted sock is filled with a granular weighted material, such that the weighted sock is formable to the interior cavity of the foot portion of the stocking.

In another embodiment, a closure at a top end of each of the plurality of sleeves is operable to retain the plurality of rods within the plurality of sleeves. The plurality of rods may be formed of a plurality of interconnecting segments.

In yet other embodiments, the stocking is made of a plurality of layers, the plurality of layers including an inner layer and an outer layer. The plurality of layers may also include a batting layer disposed between the outer layer and the inner layer.

In other aspects of the invention, a collapsible free standing stocking is disclosed having a stocking defining a foot portion, an upper sleeve portion, an opening in the upper sleeve portion providing access to an interior cavity of the stocking. A weighted sock is dimensioned to be received in the foot portion of the stocking and carries a malleable weighted material. A footpad is dimensioned to be received in the foot portion. The footpad provides a base for the stocking to be carried on a supporting substrate.

In other embodiments, a plurality of sleeves are disposed in a spaced apart relation about a circumferential dimension of the upper sleeve portion of the stocking.

A plurality of rods having a length corresponding to a length of the upper sleeve portion are adapted to be received in the plurality of sleeves and retain the upper sleeve portion in an upright orientation.

In some embodiments, the footpad is formed of a rigid or semi-rigid material.

In other embodiments, the weighted sock is filled with a granular weighted material, such that the weighted sock is formable to the interior cavity of the foot portion of the stocking.

In yet other embodiments, a closure is provided at a top end of each of the plurality of sleeves. The closure is operable to retain the plurality of rods within the plurality of sleeves.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention provide an improved Christmas stocking decoration that may be positioned in a self-supported condition, without reliance on damaging screws, dangerous weighted suspension hooks, and proximity in front of a fireplace opening. By creating a Christmas (Holiday) stocking that stands in an upright self-supported condition, the invention eliminates the possibility for children, adults and pets to be seriously injured by tugging or a pulling on traditional hanging Christmas stockings from an unsecured heavy metal footing atop fireplace mantles. It greatly reduces the potential for a life threatening fire and it preserves the integrity of expensive mantles from being damaged.

Figure 2:
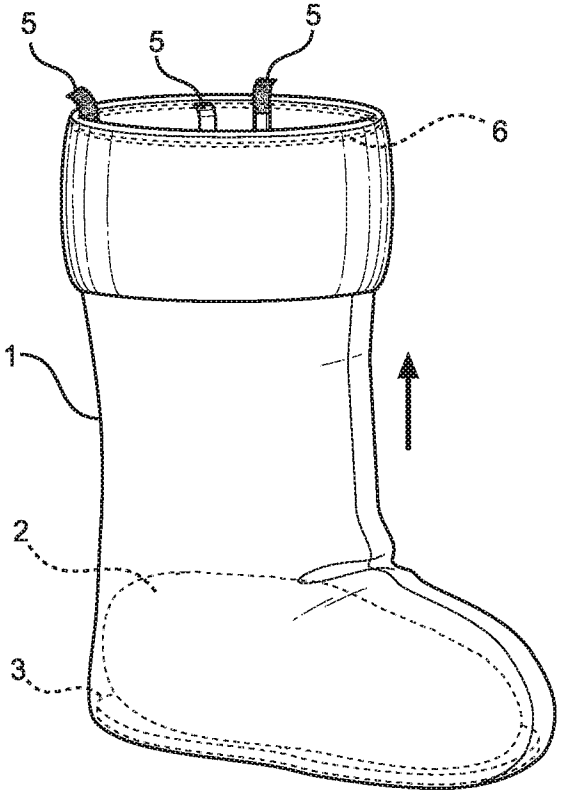
FIG. 2 shows the stocking being straightened in preparation to accept the folding tent-like poles.
Figure 1:
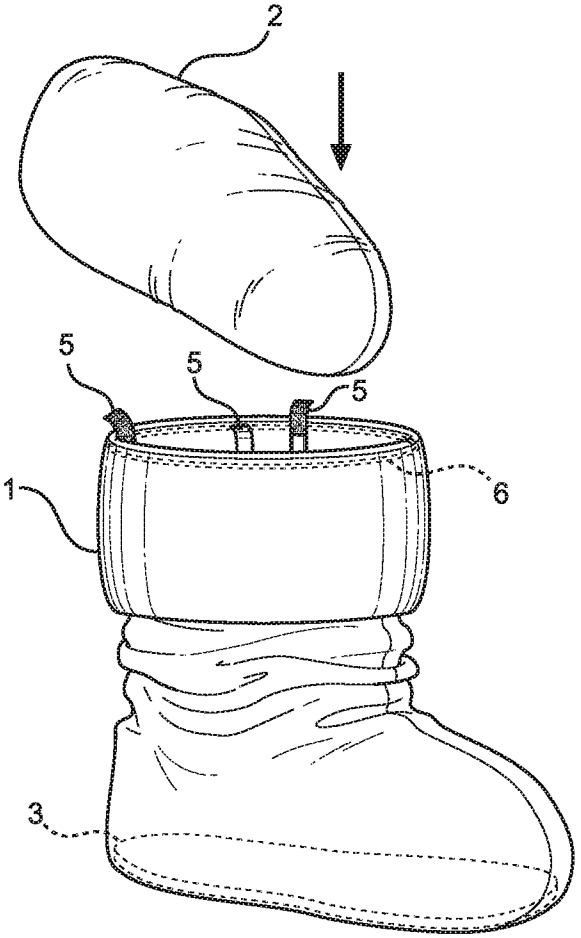
FIG. 1 shows the stocking accepting a weighted removable sock.
Figure 5:
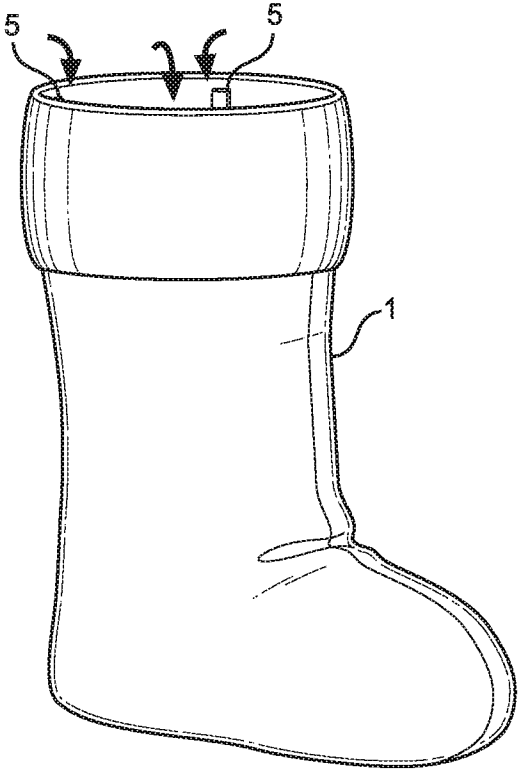
FIG. 5 shows the hook and loop fastened sleeves closed.
Figure 4:
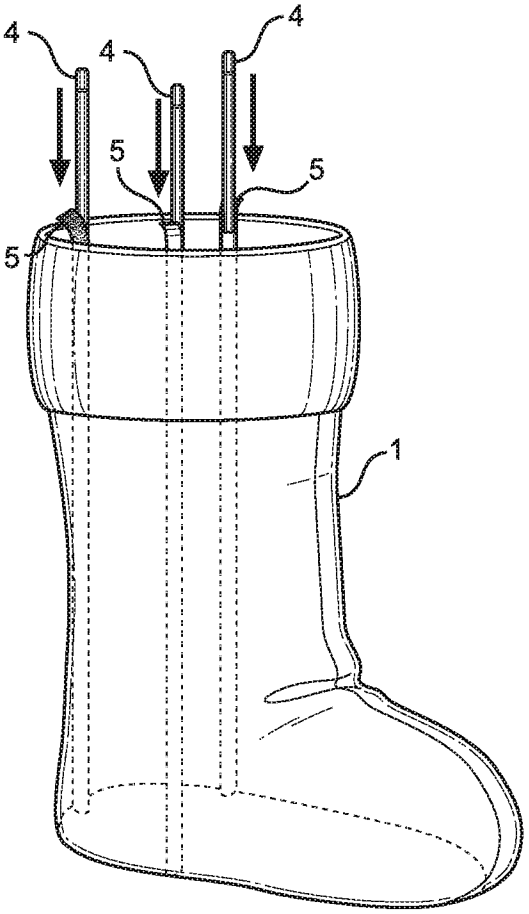
FIG. 4 shows the stocking accepting the removable folding tent-like poles into the hook and lop fastened sleeves.
Figure 3:
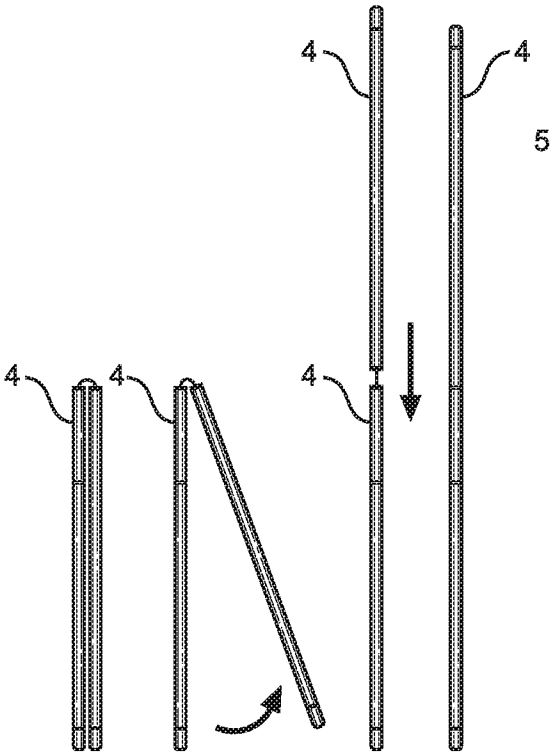
FIG. 3 shows the removable folding tent-like poles being unfolded and assembled for integration into the stocking.
Figure 6:
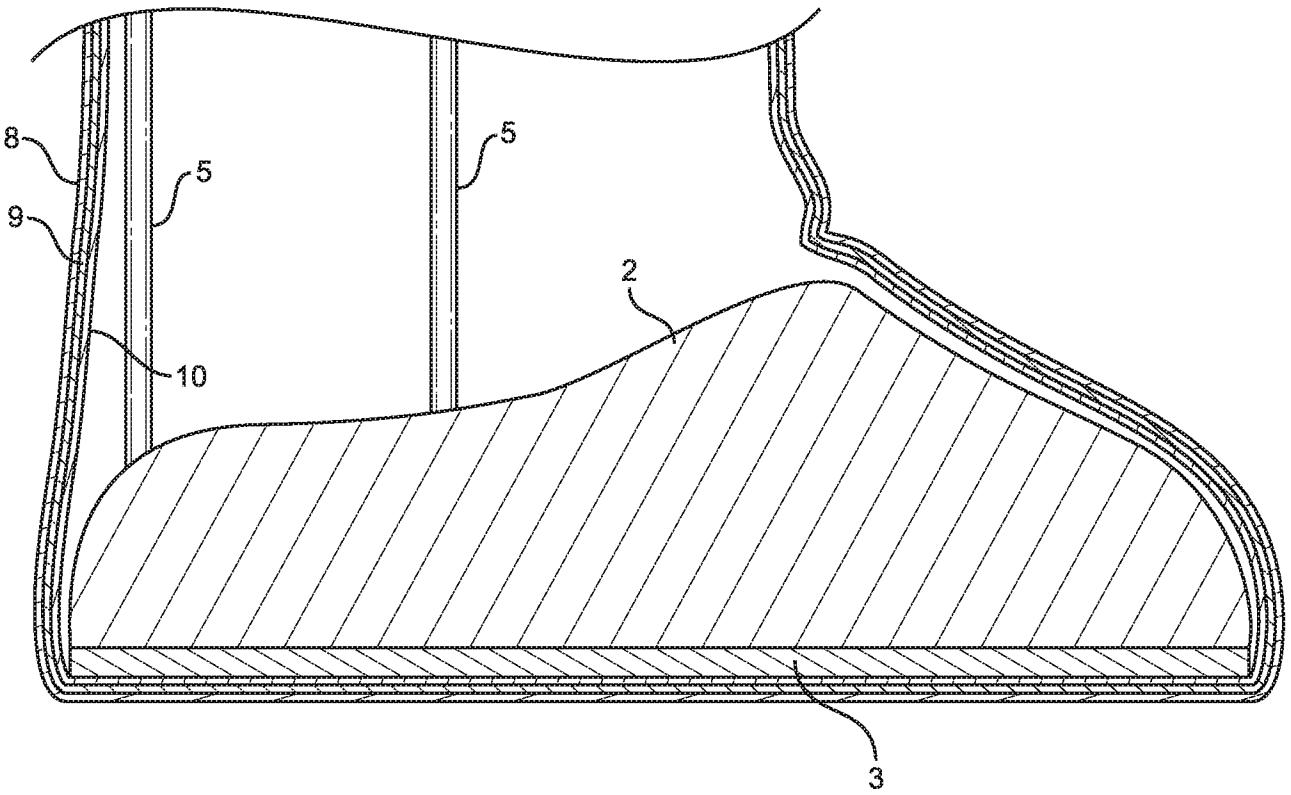
FIG. 6 is a cross section of the bottom portion of the stocking.

As seen in reference to the drawings of FIGS. 1-6, a non-limiting embodiment of a collapsible standing stocking is shown. The collapsible free standing stocking of the present invention includes a stocking 1 having a top opening to an interior cavity of the stocking body 1. A weighted removable sock element 2 is dimensioned to fit within the interior cavity. The sock element 2 is filled with a granular or pelletized weighted material to avoid the strike hazard associated with the weighted hanger plates.

A footpad 3 is formed to a base, or sole area of the stocking 1. The footpad 3 may be formed of a substantially rigid, or semi rigid material, such as medium density fiberboard, a plastic, a nylon, or similar material. The footpad 3 is shaped to form and expand the inner cavity at the base of the stocking 1. The footpad 3 may be sewn in bottom of the stocking 1 or secured with an adhesive. The sock element 2 is inserted into the interior cavity above the footpad 3.

The collapsible free standing stocking includes a plurality of support rods 4 that are received within the interior cavity of the stocking 1 to support an upper sleeve element of the stocking body 1 in an upright condition. A plurality of sleeves 5 are defined in the upper sleeve element in a spaced apart relation about the inner circumferential dimension of the stocking 1. Each of the plurality of sleeves 5 receives one of the plurality of support rods 4. A closure may be provided at a top end of each of the plurality of sleeves to retain the support rods 4 in the sleeve and to retain the stocking 1 in an upright condition.

The support rods 4 may be of a fixed length or may be formed of a plurality of interconnecting segments. The weighted sock 2 may be formed to abut with a lower end of the support rods 4 to facilitate maintaining the shape of the upper sleeve body of the stocking 1.

In some embodiments, a malleable wire 6, such as an aluminum wire, may be attached to an interior of a cuff of the stocking 1. The malleable wire 6 may be formed to retain the opening of the stocking 1 in an open condition, and formed to a desired appearance by the user. Alternatively, the malleable wire ring 6 may be bent to close the top opening of the stocking 1 so as to retain or conceal gifts that may be inserted into the interior cavity of the stocking 1. Ends of the malleable wire 6 may be joined to form a ring around the cuff opening of the stocking 1.

In some embodiments, a stuffing material 7 may be inserted into the upper sleeve of the stocking to provide shape. The stocking 1 may be formed from a plurality of layers including an outer layer 8, a batting layer 9, and an inner layer 10.

In use, the footpad 3 is inserted into the stocking 1 and is positioned within the interior cavity so that the stocking 1 has a desired orientation according to a user's preference. The weighted sock 2 is then inserted into a foot portion of the interior cavity. The weighted material carried in the weighted sock 2 may be formed to obtain a desired shape of the foot portion of the stocking according to a user's preference for the stocking display. The plurality of rods 4 may be inserted within the respective plurality of sleeves 5. The optional top closure of the sleeves 5 may then be closed to retain the sleeve element of the stocking 1 in an upright position. The weighted sock 2 may also be manipulated to retain the plurality of rods 4 in a desired orientation. An optional fill material 7 may be inserted into the sleeve element until the stocking is ready to be filled. As will be appreciated, gifts, candies, and the like may also be inserted into the stocking 1 for celebration of Christmas.

When the holidays are over, the collapsible free standing stocking may be disassembled for storage until needed again. Any fill 7, may be removed, the closures unfastened and the plurality of rods 4 removed, and collapsed, if able. The weighted sock 2 and foot pad 3 may be removed or left in position within the stocking 1.

It should be understood, of course, that the foregoing relates to exemplary embodiments of the invention and that modifications may be made without departing from the spirit and scope of the invention as set forth in the following claims.

What is claimed is:

1. A collapsible free standing stocking, comprising:

a stocking comprising an upper sleeve portion having a length, a foot portion, and a top opening to an interior cavity extending through the upper sleeve portion and the foot portion;

a weighted sock in the foot portion that is filled with a granular or pelleted material and formable to the interior cavity inside the foot portion;

a footpad in the foot portion along a base thereof;

a plurality of sleeves disposed in a spaced apart relation about a circumferential dimension of the upper sleeve portion, each of the sleeves having a closure at the top end thereof; and a plurality of removable rods, each rod comprising a plurality of interconnecting segments and each rod located in one of the sleeves and extending substantially the length of the upper sleeve portion;

wherein each closure is operable to retain one of the plurality of rods within each of the plurality of sleeves.

2. The collapsible free standing stocking of claim 1, wherein the footpad is formed of a rigid or semi-rigid material.

3. The collapsible free standing stocking of claim 1, wherein the stocking is made of a plurality of layers, the plurality of layers including an inner layer and an outer layer.

4. The collapsible free standing stocking of claim 3, wherein the plurality of layers further comprises a batting layer disposed between the outer layer and the inner layer.

5. The collapsible free standing stocking of claim 1, wherein the footpad provides a base for the stocking to be carried on a supporting substrate.

6. The collapsible free standing stocking of claim 1, wherein the plurality of rods in the plurality of sleeves retain the upper sleeve portion in an upright orientation.

* * * * *